United States Patent [19]

Frye

[11] 3,996,708

[45] Dec. 14, 1976

[54] GROUND ANCHOR WITH LOOPED TOP SUPPORT

[76] Inventor: Norman V. Frye, R.R. 4, Davenport, Iowa 52804

[22] Filed: May 24, 1976

[21] Appl. No.: 689,060

[52] U.S. Cl. ..... 52/157; 248/156

[51] Int. Cl.[2] ..... A45F 3/44; E02D 5/74

[58] Field of Search ..... 52/155, 157; 248/156

[56] References Cited

UNITED STATES PATENTS

| | | | |
|---|---|---|---|
| 3,076,532 | 2/1963 | Frye | 52/157 |
| 3,127,928 | 8/1965 | Frye | 52/157 |
| 3,328,928 | 7/1967 | Frye | 52/157 |
| 3,636,670 | 1/1972 | Frye | 52/157 |

FOREIGN PATENTS OR APPLICATIONS

| | | | |
|---|---|---|---|
| 581,915 | 10/1946 | United Kingdom | 248/156 |

*Primary Examiner*—James L. Ridgill, Jr.

[57] ABSTRACT

A ground anchor comprises a depending helical part adapted to be screwed into the ground and an upper part extending laterally from the top of the helix and being in the form of a hairpin having its legs secured to the top of the helix and a bight carrying an upright support for mounting a post for use in a game such as volleyball or the like where a net is supported between two such posts.

15 Claims, 8 Drawing Figures

GROUND ANCHOR WITH LOOPED TOP SUPPORT

BACKGROUND OF THE INVENTION

The present applicant has previously patented several ground anchors of the general class described; viz., U.S. Pat. Nos. 3,076,532; 3,197,928; 3,328,928 and 3,636,670. Each has progressively improved upon the design of its predecessors as experience has taught the need for further refinements economy of production, ability to withstand rough usage, etc.

It is well known that volleyball, when skillfully played, is the most rugged of all net games, and the net and supports or posts are subjected to considerable punishment. Unless adequate ground anchors are provided, the supports fail and the ground anchors must be reset or replaced, unless, of course, permanent anchors are used, which is not compatible with portability, as where the volleyball set — comprising net, posts and ground anchors — is used at home, playgrounds, picnic areas and the like. It is vital that a simple, sturdy and low-cost anchor be provided and among the characteristics such an anchor must possess are ease of installation, strength, durability and yieldability. Ease of installation is achieved by providing a helical ground-penetrating part that may be screwed into the ground, using the aboveground part as a crank or handle. This is known from applicant's prior patents and others. Strength and durability are obtained by making the anchor of rod-like steel having the desired degree of flexibility. Yieldability of the above-ground part, so that the anchor can yield to forces applied by the players to the net and hence to the posts, is achieved by proper design of the above-ground part, whereby this part can flex in bending and in torque and be able to recover its original shape or posture when the forces disappear.

According to the present invention, the ground anchor has improved strength and flexibility by a special design of the above-ground part, here of hairpin form having a pair of legs fixed to and extending away from the top of the helix to a bight which in turn rigidly carries a receiver means for supporting a post. Preferably, one of the legs is an integral extension of the top turn of the helix and the other leg is welded to the top of the helix to afford an integrated structure. Further, the post-supporting member is secured to the bight of the hairpin by a double-plate construction including one plate above and a second plate below the bight, and the plates, post-supporting member and bight are all rigidly secured together. Additionally, the bottom plate is of ramp- or skid-like form so that the anchor may be readily screwed into the ground without causing the bight to dig into the turf or sod.

Still further, the formation of the anchor is such that when initially screwed into the ground until the bight ramp contacts the ground, the top portion of the helix is still somewhat above the ground and the post-supporting member is upright, and, when further turns are applied to the anchor by means of the post-supporting member and hairpin portion as a crank or handle, the helix goes further into the ground, the junction of the hairpin and helix flexes and the post-supporting member is caused to tilt toward the helix angle extended. Thus, when both anchors are installed and the net posts are in place, the posts diverge upwardly, and the net may be properly tensioned by drawing the posts into vertical parallelism, the hairpin flexing to enable this result. The double or hairpin leg increases the strength of the anchor and thus adds to the ability of the anchor to resist destruction. Other features and advantages will become apparent as a preferred embodiment is disclosed hereinafter.

DESCRIPTION OF THE PREFERRED EMBODIMENT

Figure 1:
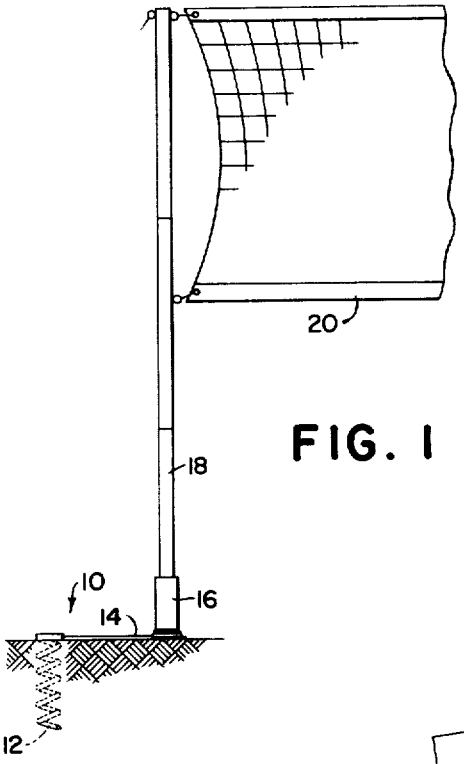
FIG. 1 is a reduced scale "environmental" view, showing one anchor in use in a typical net-supporting posture.

The ground anchor is designated generally at 10 as including a structure of generally L shape, having a depending or vertical portion in the form of a helix 12 screwed into the ground and further having a second portion 14 extending from the top of the helix and carrying a post-supporting member 16 in which is received the lower end of a net-supporting post 18 which in turn carries one end of a volleyball or like net 20.

Figure 4:
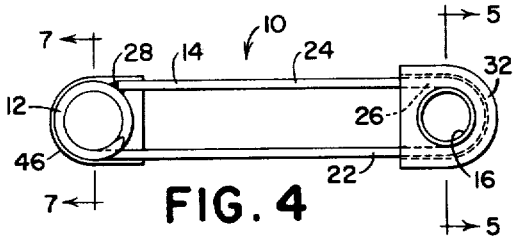
FIG. 4 is a bottom plan view as seen from below FIG. 2.

The anchor 10, to the extent that it includes the helix 12 and above-ground member or part 14, is preferably of one-piece rod-like steel, relatively stiff but sufficiently springy for the purposes intended. Generally, the rod will be approximately one-half inch in cross-section. The above-ground portion 12 is of generally hairpin or like shape, having two legs 22 and 24 which lie generally horizontally coplanar and here parallel. The leg 22 is an extension or continuation of the top turn of the helix 12, and the legs are joined relatively remote from the top of the helix by an integral bight or U-shaped portion 26. The free or terminal end of the leg 24 returns into close proximity to the top of the helix and is welded thereto at 28 (FIG. 4). Thus the parts 12 and 14 are integrated, and the part 14 is of double-legged construction.

Figure 6:
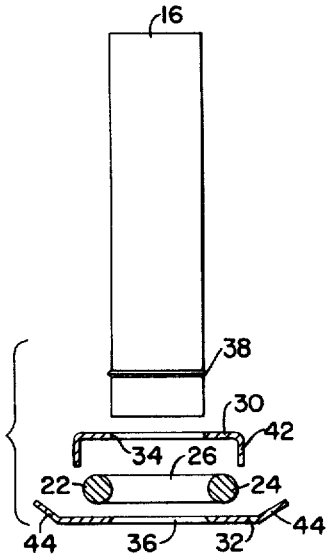
FIG. 6 is an "exploded" view of the parts seen in FIG. 5.

The bight 26 carries rigidly thereon the previously referred to post-supporting member 16, here a short length of tubing of circular cross-section. Securing of the tube 16 to the bight 26 is accomplished by top and bottom plates 30 and 32, the former engaging the bight from above and the latter from below. The upper of top plate 30 has a circular aperture 34 (FIG. 6) in substantial vertical register with the bight 26, and the lower or bottom plate has a like aperture 36 (also FIG. 6). The lower end portion of the tube 16 closely fits both apertures, extending through the bight and having upper and lower abutment means, the former comprising an exterior annular shoulder or bead 38 rolled or otherwise integrally formed in the tube and the latter being a flared annular shoulder 40. The bottom plate aperture 36 is the section of a cone having its larger diameter downwardly disposed and the flared shoulder 40 is a like section of a cone complementing the conical aperture 36. The assembly is accomplished by any conventional rolling and flaring operation, the axial spacing of the shoulders being such with respect to the spacing of the plates and the thickness of the bight 26 that the bight is tightly sandwiched between the plates. This type of construction integrates the post-supporting member or tube 16 with the anchor parts 12 and 14, the plates, shoulder and apertures comprising means securing the tube to the bight.

The top plate 30 has a depending marginal skirt 42 that conforms to and closely fits about the bight 26 and also engages the top of the bottom plate 32. This adds to the strength and rigidity of the junction between the plates and bight and tube 16. The side edges 44 of the bottom plate are turned up slightly at an angle in ramp or skid fashion so that the sod or turf is not damaged by the bight when the anchor is "cranked" into the ground, these sides extending of course beyond the proximate legs 22 and 24 (FIG. 4). Further, the bottom plate affords a greater ground-contact area and stabilizes the support of the net posts 18.

Figure 7:
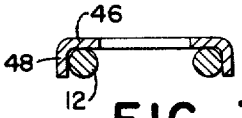
FIG. 7 is an enlarged section on the line 7—7 of FIG. 4.

A second top plate 46, centrally apertured in register with the inside diameter of the helix 12, is fitted over the top of the helix (FIG. 7) and has a depending semi-annular skirt 48 depending alongside a portion of the helix top and also along associated portions of the legs 22 and 24 of the hairpin 14. This plate is suitably welded to the top of the helix and serves, among other things, to cover the weld 28.

Figure 2:
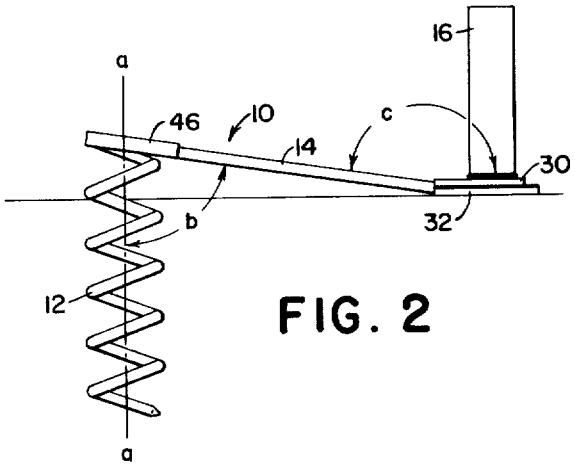
FIG. 2 is an enlarged view of the anchor per se, screwed into the ground to an initial position.
Figure 3:
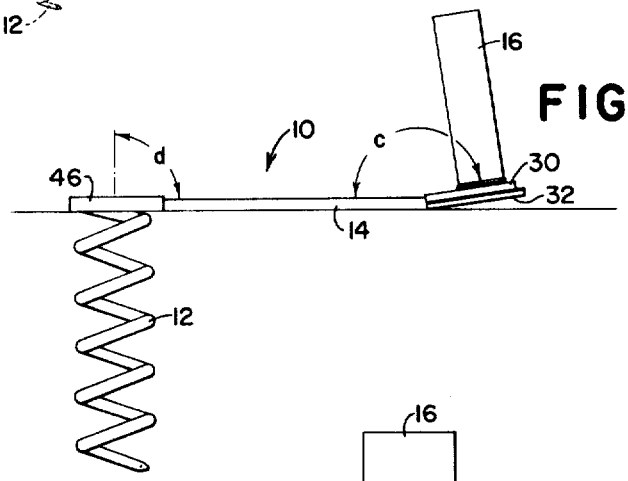
FIG. 3 is a similar view of the anchor as screwed into the ground to its final position.
Figure 5:
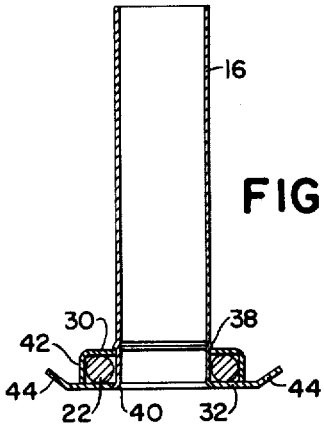
FIG. 5 is an enlarged section as seen along the line 5—5 of FIG. 4.

A further feature of the invention will be understood by a comparison of FIGS. 2 and 3, the former showing the initial installation of the anchor and the latter the final phase. The construction of the anchor is such that the junction of the hairpin 14 with the top of the helix is at an angle of slightly less than 90°, preferably on the order of between 75 and 80°, as shown by the angle *b* between the axis *a—a* extended of the helix and the portion 14 in FIG. 2. There is a slight bend in the portion 14 where the legs 22 and 24 meet the helix, providing an angle of less than 180°, as at angle *c*, which angle is normally determined on the basis of angle *b*. In FIG. 2, the axis of the tube 16 is upright, being parallel to the axis *a—a* of the helix 12. This means that the net post 18 would also be vertical, and if the anchors were used in this position, tensioning of the net would cause the posts to converge upwardly, a situation not desired. Thus, the anchor must be screwed further into the ground, using the portion 14 and tube 16 as a handle or crank. This results in the position of FIG. 3. Further cranking of the helix into the ground occurs because of a slight lift by the user on the arm or portion 14, flexing the juncture of the portion 14 with the helix 12 in the area of angle *b*, so that, ultimately, the helix penetrates the ground farther and in the end the tube 16 inclines to the position shown in FIG. 3, retaining the angle *c* and causing the tube 16, and consequently the net post 18, to tilt outwardly or in the direction of the helix axis extended. When both net posts are considered, the result is that the posts diverge upwardly, but when the net is tensioned, the posts become substantially vertical, keeping the net properly tight. At the same time, the portion 14 lies flat on the ground (angle *d*, FIG. 3), eliminating a possible obstruction.

Figure 8:
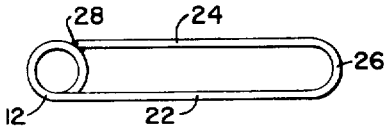
FIG. 8 is a view similar to FIG. 4 but without the post-supporting portion and associated plate members.

As a further means of utilizing the basic features of the invention, the double-legged or hairpin construction can be used as a tie-down, as shown in FIG. 8, where the tube 16 and plates 30 and 32 are omitted. Also, to simplify construction, the plate 46 may be omitted. Otherwise, the construction may be the same as that previously described. Again, the final screwed-in position results in the legs 22 and 24 lying flat on the ground and eliminating the possibility that someone would trip over the legs if they occupied a position comparable to that shown in FIG. 2.

The type of ground anchor provided according to the present invention is designed primarily for institutional and like usage, where the installation is what may be termed semi-permanent; i.e., the net, etc. are generally always available for use, often without adequate supervision and therefore more apt to be subject to destructive forces or abuse. The double-legged construction at 22-24 substantially defies such mistreatment. Despite the added rigidity afforded by the double-legged construction, the anchor possesses the necessary ability to flex in response to rugged play. The ramp or skid sides 44 further enhance the ability of the above-ground part 14 to "roll with the punch" in response to forces at right angles to the net. The built-in net tensioning provided by the angles *b* and *c* are significant from the standpoint of keeping the net tight without encroachment of leaning posts into the net area.

The design is such that it exploits readily available materials and thus results in a superior product at a relatively low cost, one that is durable, flexible and easily manipulated. Further features and advantages will be obvious to those skilled in the art.

I claim:

1. A ground anchor and post support comprising a generally L-shaped member having a first vertical portion in the form of a helix adapted to penetrate the ground and a second portion extending generally horizontally from the top of the helix, said second portion being of hairpin shape having a pair of generally horizontally coplanar and spaced-apart legs joined by a bight relatively remote from the helix, a first of said legs being fixed to the top of the helix and the second of said legs having its terminal end proximate to the top of the helix, and a substantially upright post-supporting member rigidly secured to and rising from the bight.

2. The invention defined in claim 1, in which the first leg is integral with the top of the helix and the terminal end of the second leg is welded to the top of the helix.

3. The invention defined in claim 2, in which the top plate has an integral substantially semi-cylindrical marginal skirt conforming to and closely fitting the exterior of the bight and depending toward the bottom plate.

4. The invention defined in claim 2, in which the L-shaped member is of stiff but springy material, the first leg of the hairpin portion is an integral continuation of the top turn of the helix and extends away from the helix at an angle of less than ninety degrees to the axis of the helix, the second leg is disposed at the same angle to the helix axis, the junctions of the legs with the bight form an angle of slightly less than 180° so that the axes of the helix and post-supporting member are parallel, whereby, when the helix is screwed into the ground to the extent that the bight touches the ground, the hairpin legs incline downwardly from the top of the helix to the ground and the bight lies on the ground and the post-supporting member is upright, and whereby, when the helix is screwed further into the ground by means of the hairpin and post-supporting member as a handle, the hairpin legs flex at their junction with the helix and lie flat on the ground and the bight inclines upwardly from the ground so that the post-supporting portion tilts in the direction of the helix axis extended.

5. The invention defined in claim 2, including a plate overlying the top of the helix and having a substantially semi-cylindrical depending skirt covering the top of the helix and the junction of the hairpin legs with the helix, and means rigidly securing the plate to the top portion of the helix.

6. The invention defined in claim 5, in which the means securing the plate to the top portion of the helix includes a welding of the two together.

7. The invention defined in claim 2, including top and bottom plates engaging the bight respectively from above and below, means securing the plates together with the bight sandwiched between them, and means rigidly securing the post-supporting member to at least one of the plates.

8. The invention defined in claim 7, in which the bottom plate has opposite sides projecting respectively laterally beyond the respective legs and said sides are turned upwardly in ramp fashion.

9. The invention defined in claim 7, in which the post-supporting member is rigidly secured to both plates.

10. The invention defined in claim 2, including a bottom plate engaging the bight from below, a top plate engaging the bight from above and having an aperture therein generally in vertical register with the bight, said post-supporting member extending downwardly through and in close-fitting relation to the aperture and into the bight and engaging the bottom plate, and means rigidly securing the bight, plates and post-supporting member together.

11. The invention defined in claim 10, in which the bottom plate has an aperture tightly receiving the lower end portion of the post-supporting member, said post-supporting member has abutment means thereon engaging the top plate from above, and the lower end portion of the post-supporting member has abutment means engaging the bottom plate from below.

12. The invention defined in claim 11, in which both abutment means comprise exterior annular shoulders integral with the post-supporting member.

13. The invention defined in claim 12, in which the lower end portion of the post-supporting member is tubular and the bottom plate aperture is a section of a cone having its larger diameter downwardly, and the bottom shoulder is a like section of a cone complementing and tightly fitting the bottom plate aperture.

14. A ground anchor comprising a generally L-shaped member having a first portion in the form of helix adapted to be screwed into the ground and a second portion extending generally horizontally away from the top of the helix, said second portion being of hairpin shape having a pair of generally horizontally coplanar legs joined by a bight relatively remote from the helix, a first of said legs being an integral extension of the top turn of the helix and the second leg having its terminal end in close proximity to the top of the helix.

15. The invention defined in claim 14, in which the terminal end of the second leg is welded to the top of the helix.

* * * * *